US009364091B2

(12) United States Patent
Costaglia

(10) Patent No.: US 9,364,091 B2
(45) Date of Patent: Jun. 14, 2016

(54) TILT MECHANISM FOR A CHAIR AND CHAIR

(75) Inventor: Massimo Costaglia, Santa Giustina in Colle (IT)

(73) Assignee: L&P Property Management Company, South Gate, CA (US)

( * ) Notice: Subject to any disclaimer, the term of this patent is extended or adjusted under 35 U.S.C. 154(b) by 439 days.

(21) Appl. No.: 13/818,426

(22) PCT Filed: Aug. 25, 2010

(86) PCT No.: PCT/EP2010/005216
§ 371 (c)(1),
(2), (4) Date: Apr. 10, 2014

(87) PCT Pub. No.: WO2012/025135
PCT Pub. Date: Mar. 1, 2012

(65) Prior Publication Data

US 2013/0221719 A1 Aug. 29, 2013

(51) Int. Cl.
*A47C 3/026* (2006.01)
*A47C 1/024* (2006.01)
*A47C 1/032* (2006.01)

(52) U.S. Cl.
CPC ..... *A47C 1/032* (2013.01); *A47C 1/03255* (2013.01); *A47C 1/03294* (2013.01)

(58) Field of Classification Search
CPC . A47C 1/032; A47C 1/03294; A47C 1/03255
USPC ..... 297/285–299, 300.1–301.7
See application file for complete search history.

(56) References Cited

U.S. PATENT DOCUMENTS 5,333,368 A * 8/1994 Kriener ..... A47C 1/024 297/302.1
5,348,372 A * 9/1994 Takamatsu ..... A47C 1/0325 297/301.1

(Continued)

FOREIGN PATENT DOCUMENTS

EP 1358821 A1 11/2003
WO 1986002536 A1 5/1986
WO 2008149224 A1 12/2008

OTHER PUBLICATIONS

International Preliminary Report on Patentability and Written Opinion, mailed Mar. 7, 2013, in PCT/EP2010/005216, 10 pp.

*Primary Examiner* — Rodney B White
(74) *Attorney, Agent, or Firm* — Shook, Hardy & Bacon, L.L.P.

(57) ABSTRACT

A tilt mechanism (10) for a chair comprises a base (11), a back bracket (12) configured to support a chair back (4) and a coupling arrangement (16, 25) configured to couple the back bracket (12) to the base (11). The coupling arrangement comprises a guide track (25) and a guide member (16). One of the guide track (25) and the guide member (16) is provided on a portion of the back bracket (12) extending from a back attaching portion (23) to a pivot coupling portion (24) at which the back bracket (12) may be articulated to a chair seat (3). The other one of the guide track (25) and the guide member (16) is provided on the base (11). When the coupling arrangement (16, 25) couples the back bracket (12) to the base (11), pivoting the back bracket (12) about the pivot coupling portion (24) causes the guide member (16) and the guide track (25) to be displaced relative to each other, effecting a displacement of the pivot coupling portion (24) relative to the base (11).

19 Claims, 7 Drawing Sheets

(56) References Cited

U.S. PATENT DOCUMENTS

| | | | | |
|---|---|---|---|---|
| 5,397,165 | A * | 3/1995 | Grin et al. | 297/300.5 |
| 5,660,439 | A | 8/1997 | Unwalla | |
| 6,367,877 | B1 | 4/2002 | Knoblock et al. | |
| 6,685,267 | B1 | 2/2004 | Johnson et al. | |
| 6,945,602 | B2 * | 9/2005 | Fookes | A47C 1/03255 297/300.2 |
| 7,611,202 | B2 | 11/2009 | Johnson et al. | |
| 7,614,697 | B1 | 11/2009 | Lai | |
| 8,613,482 | B2 * | 12/2013 | Ni | A47C 1/026 297/302.1 |
| 2006/0202529 | A1 * | 9/2006 | Johnson et al. | 297/286 |
| 2007/0290537 | A1 | 12/2007 | Lin | |
| 2009/0218864 | A1 * | 9/2009 | Parker et al. | 297/300.2 |
| 2010/0164263 | A1 * | 7/2010 | Malenotti | A47C 1/03255 297/300.1 |
| 2012/0007400 | A1 * | 1/2012 | Behar et al. | 297/285 X |
| 2012/0086251 | A1 * | 4/2012 | Parker et al. | 297/285 |

* cited by examiner

TILT MECHANISM FOR A CHAIR AND CHAIR

CROSS-REFERENCE TO RELATED APPLICATIONS

This application claims priority to PCT Application No. PCT/EP2010/005216, titled "Tilt Mechanism For a Chair and Chair," filed Aug. 25, 2010, which is expressly incorporated by reference herein in its entirety.

FIELD OF THE INVENTION

The invention relates to a tilt mechanism for a chair and a chair. The invention relates in particular to a tilt mechanism for a chair having a chair seat and a chair back, in which the tilt mechanism allows the chair seat to be displaced and the chair back to be reclined in a coordinated manner.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. One common configuration for such a chair includes a mobile chair base assembly to allow the chair to roll across a floor and a pedestal column supporting the superstructure of the chair. The superstructure may include components which enable the user to adjust certain settings of the chair and to facilitate recline or "tilt" of the chair superstructure, including the seat and back of the chair. This basic chair configuration allows users to change their sitting position in the chair as desired, such that fatigue may be minimized during long sitting periods.

In recent years, chair designs have implemented a feature where a chair back and seat both move simultaneously during a tilting or rearwardly reclining movement of the chair back. The chair seat may also tilt in this process or may be displaced otherwise relative to the chair base. The combined movement of the chair back and seat in these designs results in some level of improvement for the occupant through a range of tilting motions over a conventional "static" chair without coordinated back and seat movement.

For enhanced comfort, the coordinated movement of the chair back and chair seat should ideally account of the user's physique. The user's motion, when reclining his upper body relative to his thighs, may involve a rotation about his hip joints. It is desirable to support the user in this process.

Various configurations may be realized to implement such a coordinated movement of the chair back and chair seat. For illustration, the seat back may be articulated to an arm rest support or to a base at a location forward from the chair back. In order to implement a desired reclining or tilting movement of the chair back, guide elements have been provided on a rear side of the chair back. For illustration, a guide track may be formed on a rear side of the chair back, and a follower provided on a member which extends from the chair seat to the rear side of the chair back may be moved along the guide track as the chair seat moves, thereby causing the chair back to tilt. Providing such a member which extends from the chair seat to and along the rear side of the chair back may be undesirable for a variety of reasons, including the restrictions imposed on chair design or similar.

There is a need in the art for a tilt mechanism and chair which provides good support to the user during a reclining motion. There is a need in the art for such a tilt mechanism and chair which obviates the need for elements extending on the rear side of the chair back and across a significant portion of the chair back.

BRIEF SUMMARY OF THE INVENTION

There is a continued need in the art for a chair tilt mechanism and a chair which address some of the above needs.

According to an embodiment, a tilt mechanism is provided. The tilt mechanism comprises a base configured to be coupled to a chair base assembly, a back bracket and a coupling arrangement. The back bracket comprises a back attaching portion configured to be attached to the chair back and a pivot coupling portion configured to pivotably couple the back bracket to the chair seat. The coupling arrangement is configured to couple the back bracket to the base and comprises a guide track formed to have at least one channel and at least one guide member configured to be displaceably supported in the at least one channel. One of the guide track and the at least one guide member is provided on a portion of the back bracket extending from the back attaching portion to the pivot coupling portion. The other one of the guide track and the at least one guide member is provided on the base. The tilt mechanism is configured such that, when the coupling arrangement couples the back bracket to the base, pivoting the back bracket about the pivot coupling portion causes the guide member and the guide track to be displaced relative to each other, effecting a displacement of the pivot coupling portion relative to the base.

According to another embodiment, a chair is provided. The chair comprises a chair base assembly, a chair seat, a chair back and a tilt mechanism. The tilt mechanism has a base, a back bracket and a coupling arrangement coupling the back bracket to the base. The coupling arrangement includes a guide track and a guide member displaceably supported on the guide track. The guide track is provided on one of the base and the back bracket, and the guide member is provided on the other one of the base and the back bracket. The base of the tilt mechanism is coupled to the chair base assembly. The chair seat is displaceably coupled to the base of the tilt mechanism. The back bracket is attached to the chair back at the back attaching portion and is articulated to the chair seat at the pivot coupling portion. The chair is configured such that pivoting the chair back causes the guide member and the guide track to be displaced relative to each other, effecting a displacement of the pivot coupling portion and of the chair seat relative to the chair base assembly.

The tilt mechanism and chair according to embodiments may be utilized for various applications in which a coordinated reclining motion of the chair back and motion of the chair seat is desired.

Embodiments of the invention will be described with reference to the accompanying drawings.

Figure 1:
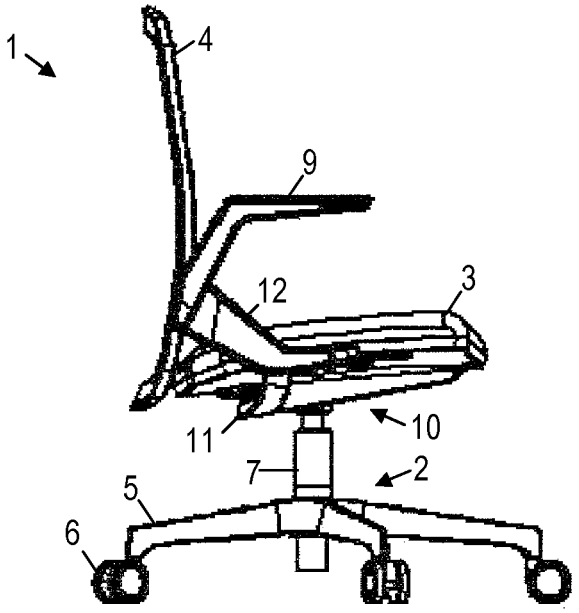
FIG. 1 is a side view of a chair having a chair tilt mechanism according to an embodiment with the chair back in its foremost position.

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise.

According to embodiments, a tilt mechanism is provided which generally includes a base configured to be coupled to a chair base assembly, a back bracket and a coupling arrangement. The coupling arrangement is configured to couple the back bracket to the base and comprises a guide track formed to have at least one channel and at least one guide member configured to be displaceably supported in the at least one channel. One of the guide track and the at least one guide member is provided on a portion of the back bracket extending from a back attaching portion to a pivot coupling portion, at which the back bracket is coupled to the chair back in use of the tilt mechanism. The other one of the guide track and the at least one guide member is provided on the base. In use, pivoting the back bracket about the pivot coupling portion causes the guide member and the guide track to be displaced relative to each other, effecting a displacement of the pivot coupling portion relative to the base. With a tilt mechanism having this configuration, it is no longer required that link members coupling the chair seat to the chair back extend across the rear side of the chair back.

The back attaching portion of the back bracket may define a mounting plane for the chair back. The tilt mechanism may be configured such that the base and the guide track are provided on the same side relative to the mounting plane when the coupling arrangement couples the back bracket to the base. This allows the coupling arrangement to be positioned in a forward direction of the chair back.

The at least one channel may be curved. The at least one channel may be radially curved. The at least one channel may have a centre of curvature which, when the coupling arrangement couples the back bracket to the base, is spaced from the pivot coupling portion. By virtue of this configuration, a forward and upward movement of the chair seat in response to a rearward movement of the chair back may be implemented.

The tilt mechanism may comprise a further back bracket comprising a further back attaching portion configured to be attached to the chair back and a further pivot coupling portion configured to pivotably couple the further back bracket to the chair seat. The tilt mechanism may comprise a further coupling arrangement configured to couple the further back bracket to the base. This allows stability to be enhanced. The further coupling arrangement may be configured analogously to the coupling arrangement. The coupling arrangement and the further coupling arrangement may have mirror-symmetric configurations.

The tilt mechanism may be configured such that, when the coupling arrangement couples the back bracket to the base and the further coupling arrangement couples the further back bracket to the base, the back bracket and the further bracket are spaced from each other so as to allow the chair seat to be positioned therebetween. In particular, the tilt mechanism may be configured to support the chair seat such that, for at least one position of the back bracket relative to the base, a portion of the chair seat is interposed between the coupling arrangement and the further coupling arrangement. Thereby, the coupling arrangement may be positioned such that it does not significantly affect the outer boundary of the chair in side view.

According to further embodiments, a chair is provided which includes a tilt mechanism according to any one aspect or embodiment. The back bracket of the tilt mechanism is articulated to a chair seat at its pivot coupling portion. The back bracket is attached to the chair back at its back attaching portion.

The chair may have a forward direction corresponding to a direction parallel to the base plane defined by the chair base assembly, with the position of the chair back being changeable in the forward direction. The coupling arrangement may be arranged in the forward direction relative to the chair back. The pivot coupling portion may be arranged in the forward direction relative to the coupling arrangement. In a chair having this configuration, coordinated movement of the chair back and chair seat is attained without requiring link members to extend across the rear side of the chair back.

The chair back may comprise a lumbar support, and the pivot coupling portion may be arranged between 150 mm and 250 mm forward from the lumbar support when the chair back is in its foremost position. This configuration provides particularly good support during a recline.

The at least one channel defined by the guide track may overlap with the chair seat, when viewed in a lateral direction of the chair, for at least one position of the chair back relative to the chair base assembly. The at least one channel may in particular overlap with the chair seat, when viewed in a lateral direction of the chair, for all positions of the chair back relative to the chair base assembly. With this construction, the coupling arrangement is positioned such that it does not significantly affect the outer boundary of the chair in a side view.

Figure 2:
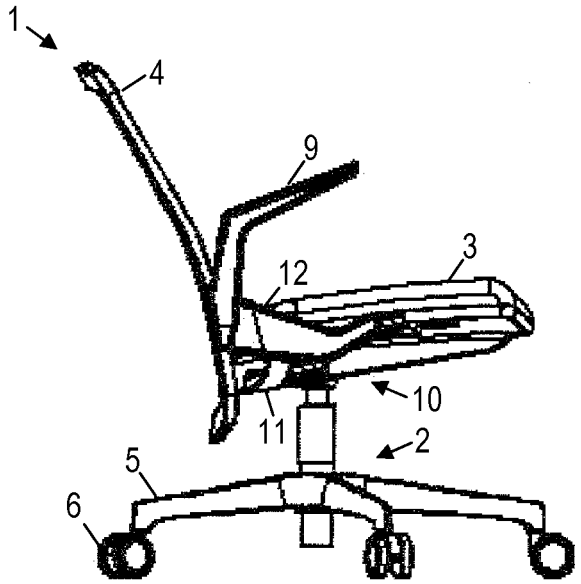
FIG. 2 is a side view of the chair of FIG. 1 with the chair back in its rearmost position.

FIG. 1 and FIG. 2 respectively show a chair 1 which includes a tilt mechanism 10 of an embodiment. The chair 1 is illustrated to be an office-type chair having a chair base assembly 2 and a superstructure. The superstructure includes a chair seat 3, a chair back 4 and components to interconnect the seat 3 with the back 4. The components, which will be described in more detail below, include a tilt mechanism 10 for effecting a coordinated movement of the back 4 and the seat 3. The base assembly 2 includes a pedestal column 7, a number of support legs 5 extending radially from the column 7 and a corresponding number of castors 6 operably supported on the outer ends of the support legs 5. A gas cylinder or other lifting mechanism may be supported by the column 7 to enable the height of the seat 3, and thus of the chair superstructure, to be adjusted by an occupant.

It should be understood that the terms "forward", "rearward" and "lateral", as used herein, each have a particular meaning that is defined in relation to a base plane defined by the chair base assembly 2 (e.g., parallel to a floor on which castors 6 rest) and in relation to an occupant of the chair. The flat support surface is defined by the chair base assembly 2. For instance, the term "forward" refers to a direction moving away from the back 4 and in front of a chair occupant along an axis which extends parallel to such a base plane, while the term "rearward" refers to a direction opposite of the forward direction. The term "lateral" refers to a direction perpendicular to both the forward and rearward direction and extending parallel to the aforementioned base plane.

The chair 1 includes a tilt mechanism 10. Generally, the tilt mechanism 10 is operative to implement a coordinated movement of the seat 3 and of the back 4 when the back 4 is tilted. The tilt mechanism 10 includes a base 11 which, in the installed state of the tilt mechanism in which the tilt mechanism 10 is incorporated into a chair, is coupled to the pedestal column 7. The tilt mechanism 10 includes a back bracket 12 which, in the installed state of the tilt mechanism 10, is attached to the chair back 4 and mounts the chair back 4. The chair back 4 may be fixedly coupled to the back bracket 12. As will be described in more detail below, the back bracket 12 is pivotably coupled to the chair seat 3 at a position forward of the chair back 4. The tilt mechanism 10 further includes a coupling arrangement which, in the installed state of the tilt mechanism 10, couples the back bracket 12 to the base 11. The coupling arrangement includes a guide track which may be provided on one of the back bracket 12 and the base 11. The guide track is disposed forwardly of the chair back 4, for all positions of the chair back 4 allowed by the tilt mechanism 10.

The tilt mechanism 10 is generally configured such that reclining the chair back 4 causes the back bracket 12 to be articulated relative to the seat 3. The coupling arrangement forces the back bracket 12 to be displaced relative to the base 11 when the chair back 4 pivots, such that the chair seat 3 is displaced relative to the base 11.

FIG. 2 illustrates the chair 1 when the chair back 4 has been reclined. Reclining the chair back 4 does not only cause the back bracket 12 to rotate about the location of its pivot coupling to the seat, but rather causes the pivot coupling and, thus, the chair seat 3 to be displaced in the forward direction. In the illustrated embodiment, the back bracket 12 is articulated to the chair seat 3 at the forward end of the back bracket 12. This end of the back bracket 12 is displaced in the forward direction of the chair, relative to the base 11 and the chair base assembly 2, by rotation of the chair back 4.

The tilt mechanism 10 may include a suitable biasing device biasing the tilt mechanism into a position in which the back 4 is in its foremost position. This state, corresponding to the rest state of the tilt mechanism 10, will also be referred to as zero-tilt position. The tilt mechanism may also be configured to limit the reclining motion of the back 4. The state in which the mechanism prevents the back 4 from being reclined further will also be referred to as full-tilt state.

Configurations of the tilt mechanism according to embodiments will be described in more detail with reference to FIGS. 3-11.

Figure 3:
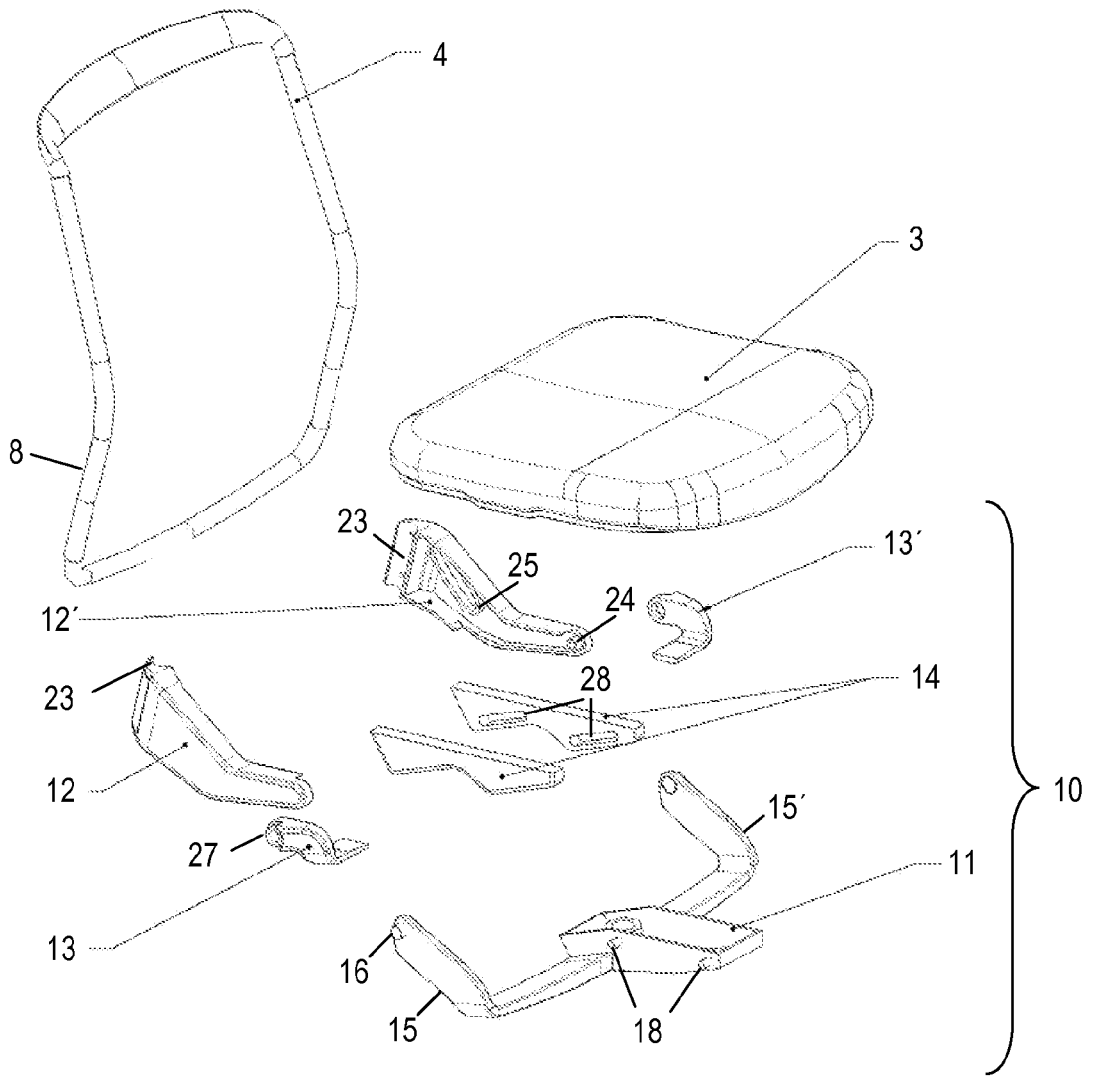
FIG. 3 is an exploded perspective view of a chair superstructure having a tilt mechanism according to an embodiment.

FIG. 3 is an exploded view of a chair superstructure having a tilt mechanism 10 according to an embodiment. The tilt mechanism 10 may be used to effect a coordinated movement of the chair seat and chair back. In the tilt mechanism 10 of FIG. 3, a coupling arrangement coupling a back bracket to a base includes a guide track formed on the back bracket and a corresponding guide member provided on the base.

The tilt mechanism 10 generally includes a base 11, a pair of back brackets 12 and 12', a coupling arrangement which couples the back bracket 12 to the base 11 and a further coupling arrangement which couples the further back bracket 12' to the base 11. While only the structures on the inner side of the back bracket 12' can be seen in FIG. 3, the back bracket 12 has a corresponding configuration. In the illustrated implementation, the back brackets 12 and 12' may be mirror-symmetric relative to the centre longitudinal plane of the tilt mechanism 10.

The back brackets 12 and 12' respectively have a back attaching portion disposed at an end thereof which, in the installed state, corresponds to the rear end of the back brackets 12 and 12'. The back attaching portion may be formed as a recess 23 having a longitudinal axis for receiving a corresponding side member 8 of the chair back 4. The back brackets 12 and 12' further include, on their end opposite to the end on which the back attaching portion 23 is provided, a pivot coupling portion 24. The pivot coupling portion 24 is formed to allow the back bracket 12 or 12' to be articulated to the chair seat 3.

In the installed state, the back bracket 12 is coupled to the base 11 via a coupling arrangement which includes a guide track 25 and a guide member 16 displaceably supported in the guide track 25. Similarly, the back bracket 12' is coupled to the base 11 via a further coupling arrangement which includes a guide track 25 and a guide member 16 displaceably supported in the guide track 25. The configuration and operation of the coupling arrangement will be described in more detail below.

The tilt mechanism 10 may further comprise a mating pivot coupling 27 portion engageable with the pivot coupling portion 24 of the back bracket 12, and a mating pivot coupling portion 27 engageable with the pivot coupling portion 24 of the back bracket 12'. For illustration, for a pivot coupling portion 24 formed as a pin, the mating pivot coupling portion 27 may be formed to define a concavity configured to rotatably receive the pin. The mating pivot coupling portions may be formed integrally with the chair seat 3. Alternatively, a separate member 13 may be provided which is configured to be attached on a bottom side of the chair seat 3 to define the mating pivot coupling portion 27 for articulating the back bracket 12 to the chair seat 3. Another member 13' may be provided which is configured to be attached on a bottom side of the chair seat 3 to define the mating pivot coupling portion 27 for articulating the further back bracket 12' to the chair seat 3.

The tilt mechanism 10 may further comprise a guide arrangement for guiding movement of the chair seat 3 relative to the base 11. The guide arrangement may have any one of a variety of forms. For illustration, a slide rail arrangement is illustrated in FIG. 3. Two slide rail members 14 are provided, which are respectively formed to have slots 28. Projections 18 formed on the base 11 are engageable with the slots 28. The slots 18 are sloped, so that the chair seat 3 is forced to move upward when it is displaced in a forward direction. Other implementations of the guide arrangement for guiding movement of the chair seat 3 relative to the base 11 may be implemented in further embodiments. For illustration, one or plural links articulated to the base 11 and to the chair seat 3 may be used to define the motion of the chair seat 3 upon recline of the chair back 4. The guide arrangement may be configured for a desired horizontal and vertical movement of the chair seat 3. For illustration rather than limitation, the tilt mechanism may be configured to provide 10 mm to 25 mm of vertical movement of the chair seat 3 and 40 mm to 70 mm of horizontal movement of the chair seat 3, while the chair back 4 is reclined from zero tilt to full tilt. Other vertical and horizontal movements of the chair seat 3 may be utilized in further embodiments. Weight compensation is attained by displacement of the chair seat 3 upon recline.

Figure 4:
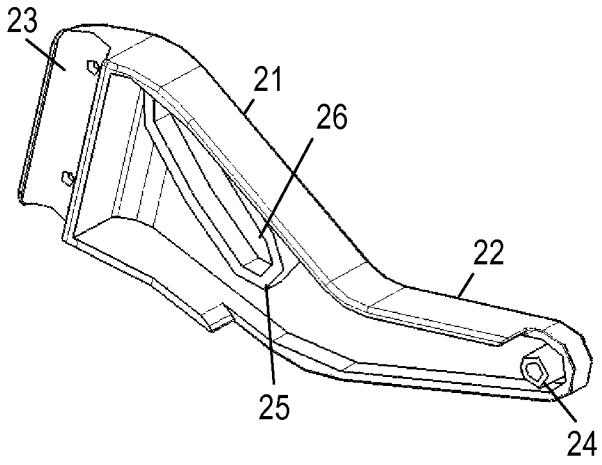
FIG. 4 is a perspective view of a back bracket of the tilt mechanism shown in FIG. 3.

The configuration of the coupling arrangement coupling the back bracket 12 or 12' to the base 11 will be described in more detail with reference to FIGS. 3 and 4. FIG. 4 shows a perspective view of the back bracket 12' disposed on one longitudinal side of the tilt mechanism 10. The back bracket 12 disposed on the opposite longitudinal side of the tilt mechanism has a corresponding configuration, which is mirror-symmetric to that of the back bracket 12'.

The back bracket 12, 12' has a first portion 21 and a second portion 22 angled relative to the first portion 21. The back attaching portion 23 is provided on one end of the back bracket, and the pivot coupling portion 24 is provided on the opposite end of the back bracket. A guide track 25 is formed on the back bracket. The guide track 25 defines a channel 26 in which a corresponding guide member 16 provided on the base 11 can be displaceably received. The guide track 25 is provided on a portion of the back bracket which extends from the back attaching portion 23 to the pivot coupling portion 24. I.e., the guide track 25 is formed on the back bracket at an intermediate location between the back attaching portion 23 and the pivot coupling portion 24.

The back attaching portion 23 of the back bracket 12 and the back attaching portion 23 of the back bracket 12' provided on opposing longitudinal sides define a mounting plane in which at least a portion of the chair back extends. In the installed state of the back bracket, the guide track 25 and the guide member 16 engaged therewith are provided on the same side, relative to the mounting plane, as the base 11. The guide track 25 and the guide member 16 engaged therewith are located in the forward direction relative to the mounting plane defined by the attaching portions 23 of the back brackets 12 and 12'.

The channel 26 defined by the guide track 25 may have a curved shape. The channel 26 defined by the guide track 25 may in particular have a radial shape. It will be appreciated that the channel 26 defined by the guide track 25 has a centre of curvature which is different from the pivot coupling portion 24. When the back bracket is installed in the chair, the centre of curvature of the channel 26 will typically be arranged at a distance from the chair base plane which is greater than a distance of the top face of the chair seat 3 from the chair base plane, i.e., the centre of curvature of the channel 26 will be located higher than the top face of the chair seat 3.

As will be described in more detail with reference to FIGS. 5 and 6, the pivot coupling portion 24 may be attached to the chair seat 3 on a lateral side and at a position below the top face of the seat cushion. The guide track 25 may be provided on the back bracket such that at least a portion of the channel 26 is disposed laterally offset relative to the chair seat 3, at least for the state in which the chair back is in its foremost position and/or in its rearmost position. This arrangement allows the back bracket 12 to be positioned such that it has a significant overlap with the chair seat and chair base when viewed in a lateral direction, which may be desirable in view of chair design.

The guide member 16 which is displaceably received in the channel 26 is provided on the base 11. The base 11 includes two side wings 15 and 15' which are provided to be spaced from each other. The guide member 16 is provided on the side wing 15. A corresponding guide member is provided on the opposite side wing 15'. The guide member 16 may be formed as a pin, roller or other projection which can be displaceably received in the channel 26. The guide member 16 on the side wing 15 and the guide member on the opposite side wing 15' may be positioned such that the chair seat 3 is interposed between the guide members 16 formed on the side wings 15 and 15' at least when the chair back 4 is in its foremost position and the chair seat 3 is in its rearmost position. The guide member 16 on the side wing 15 and the guide member on the opposite side wing 15' may be positioned such that the chair seat 3 is interposed between the guide members 16 formed on the side wings 15 and 15' for all positions of the chair back 4 and chair seat 3 relative to the base 11.

In use of the tilt mechanism 10, the back bracket 12 and the further back bracket 12' are fixedly attached to the chair back 4. When the chair back 4 pivots, the back bracket 12 is pivoted about its pivot coupling portion 24, and the further back bracket 12' is pivoted about its pivot coupling portion 24. The resultant relative displacement of the guide track 25 and the guide member 16 causes the pivot coupling portion 24 to be displaced in a forward or rearward direction of the chair. With the back bracket 12 and the further back bracket 12' being articulated to the chair seat 3, this effects a displacement of the chair seat 3 in the forward or rearward direction of the chair.

The configuration and operation of the tilt mechanism 10 will be described further with reference to FIGS. 5-8.

Figure 5:
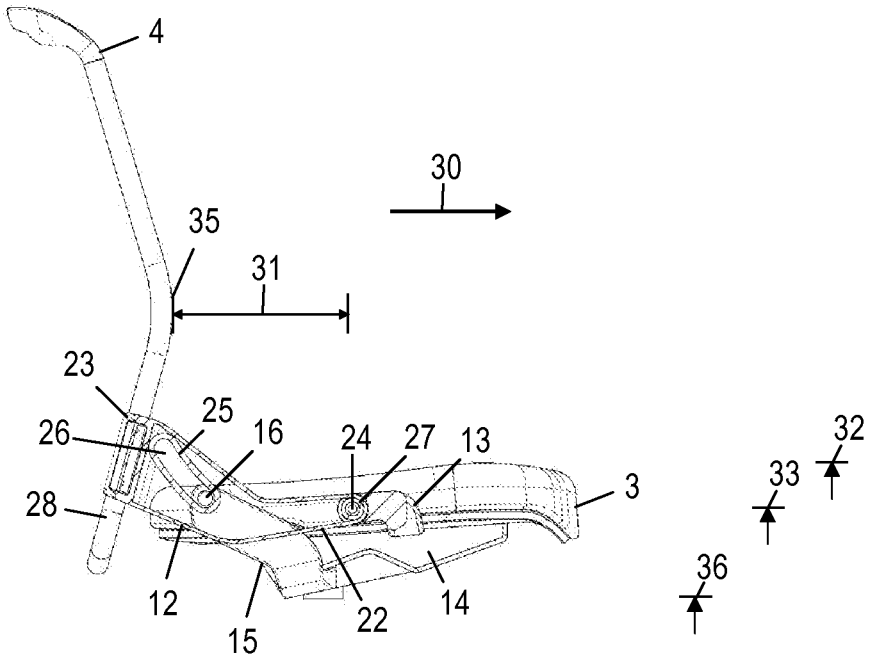
FIG. 5 is a cross-sectional view of the chair superstructure of FIG. 3 with the chair back in its foremost position.
Figure 6:
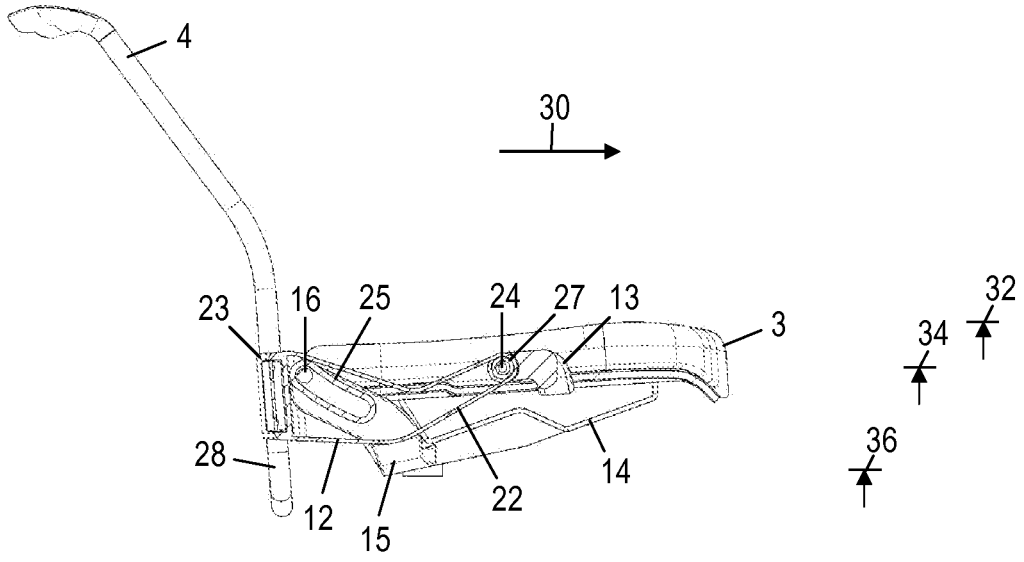
FIG. 6 is a cross-sectional view of the chair superstructure of FIG. 3 with the chair back in its rearmost position.

FIG. 5 is a cross-sectional view of the chair superstructure of FIG. 3 with the chair back in its foremost position, and FIG. 6 is a cross-sectional view of the chair super-structure of FIG. 3 with the chair back in its rearmost position. The cross-sectional views are respectively taken on a plane intersecting the guide track 25 and the guide member 16 disposed therein.

The chair has a forward direction 30. The forward direction 30 is conventionally defined to be a direction parallel to the chair base plane defined by the chair base assembly, with the seat back and seat chair being displaceable in the forward direction. The back bracket 12 is articulated to the chair seat 3 via the member 13. The centre of the pivot coupling portion 24 is disposed a length 31 forwardly from a lumbar support 35 of the chair back 4. In embodiments, the length 31 may be in the range from 150 mm to 250 mm. For this arrangement of the pivot coupling portion from the lumbar support, a relative movement of the chair back 4 and chair seat 3 during recline may be implemented which mimics the motion of the occupant's upper body relative to his thighs about his hip joints. This may be desirable to provide particularly good support during recline.

The back attaching portion 23 of the back bracket 12 and the back attaching portion 23 of the back bracket provided on the opposite lateral side of the chair define a mounting plane in which a portion 28 of the chair back extends. It will be appreciated that the coupling arrangement formed by the guide track 25 and the guide member 16 received in the channel 26 is provided on the same side of this mounting plane as the base 11 and the chair seat 3. While it is still possible to provide the chair with elements which extend across the rear side of the chair back 4, if desired for design reasons or other reasons, the tilt mechanism 10 does not require such elements to be provided.

With the guide track 25 formed in a portion of the back bracket 12 intermediate between the back attaching portion 23 and the pivot coupling portion 24, the coupling arrangement formed by the guide track 25 and the guide member 16 received in the channel 26 is generally disposed in a forward direction relative to the chair back 4, while the pivot coupling portion 24 remains positioned in a forward direction relative to the coupling arrangement with the guide track 25 and the guide member 16, for all positions of the tilt mechanism 10.

As seen in FIGS. 5 and 6, the guide track 25 overlaps with the chair seat 3, when viewed in the lateral direction (normal to the drawing plane of FIGS. 5 and 6) both when the chair back 4 is in its foremost position and when the chair back 4 is in its rearmost position. A maximum height of the chair seat 3 from a chair base plane defined by the chair base assembly is indicated at 32 in FIGS. 5 and 6. When the chair back 4 is in its foremost position, a lower end of the channel 26 defined by the guide track 25 is disposed at a height 33 above the chair base plane, which is lower than the maximum height 32 of the chair seat 3. I.e., the channel defined by the guide track 25 extends to positions located lower than the top face of the chair seat. The height 33 of the lower end of the channel above the chair base plane may be greater than the height 36 of the bottom end of the base 11 above the chair base plane. I.e., the channel 26 defined by the guide track 25 may be located higher than the bottom face of the base 11. When the chair back 4 is in its foremost position, the portion of the back bracket 12 on which the pivot coupling portion 24 is provided extends parallel to the chair seat 3. As can be seen in FIGS. 5 and 6, this configuration has the effect that a significant portion of the back bracket 12 is located so as to overlap with the chair seat 3 and base 11 when viewed from a side. This may be desirable to enhance appearance of the chair.

When the chair back 4 pivots, the back bracket 12 fixedly attached thereto also pivots about the pivot coupling portion 24. The guide member 16 provided on the base 11 forces the guide track 25 to be displaced relative to the guide member 16, so that the channel 26 defined by the guide track 25 moves along the guide member 16. When the chair back 4 pivots in a rearward direction, the pivot coupling portion 24 of the back bracket 12 is displaced in the forward and upward direction, forcing the chair seat 3 to be also displaced in the forward and upward direction. This movement is effected by the interplay of the articulated movement of the back bracket 12 about the pivot coupling portion 24, and by the relative displacement of the guide member 16 and the curved channel 26 defined by the guide track 25, which has a centre of curvature offset from the pivot coupling portion 24. When the chair back 4 pivots in a forward direction, the pivot coupling portion 24 of the back bracket 12 is displaced in the rearward and downward direction, forcing the chair seat 3 to be also displaced in the rearward and downward direction.

The specific path along which the chair seat 3 is displaced when the chair back 4 may also be influenced by the configuration of the guide arrangement which guides movement of the chair seat 3 relative to the base 11.

Figure 7:
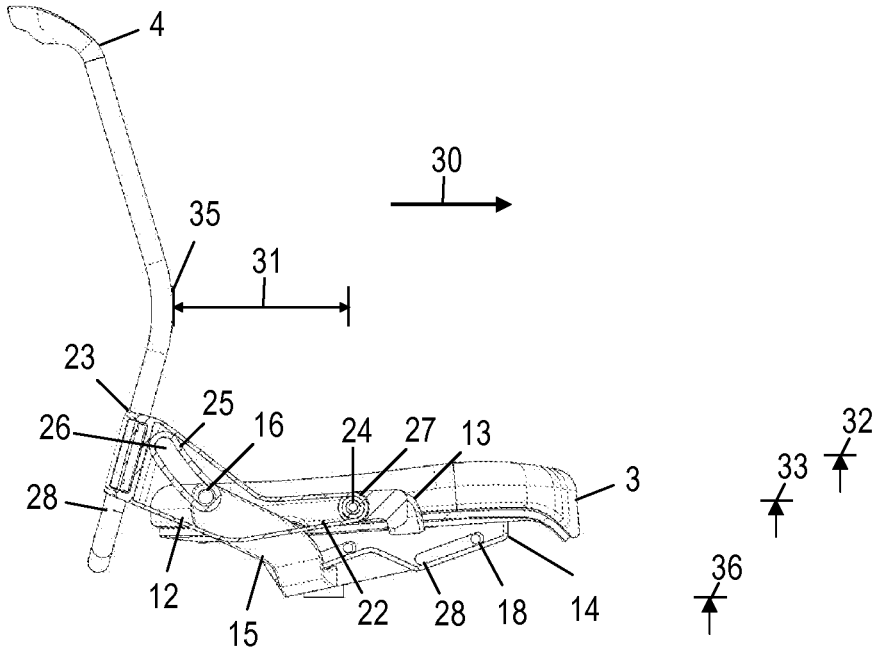
FIGS. 7 and 8 are cross-sectional views similar to FIGS. 5 and 6, illustrating displacement of a chair seat according to an embodiment in more detail.
Figure 8:
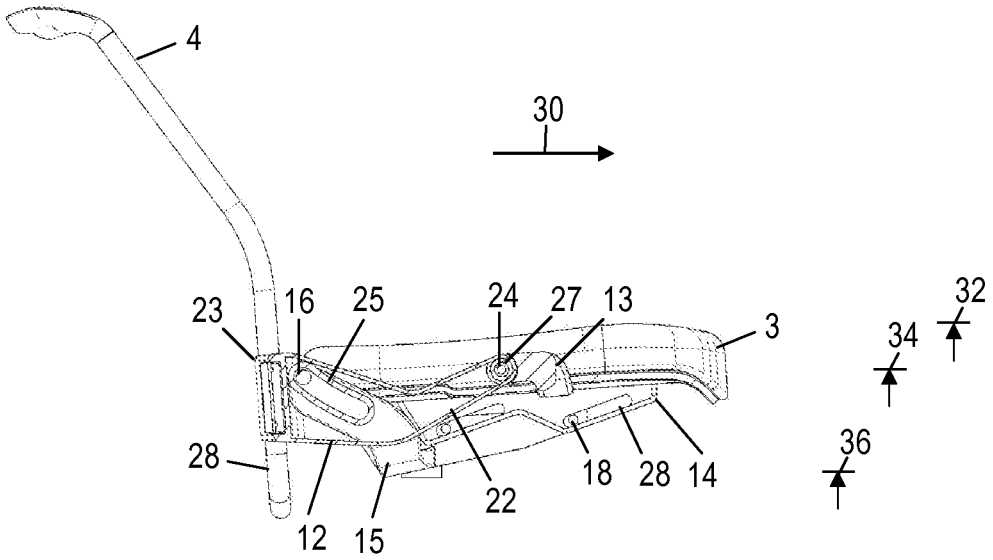

FIGS. 7 and 8 illustrate cross-sectional views of the chair superstructure similar to FIGS. 5 and 6, respectively, but with one of the slide rail members 14 removed in order to illustrate the displacement of the chair seat 3 relative to the base 11.

FIG. 7 shows the chair superstructure with the chair back 4 in its foremost position. In this state, the chair seat 3 may be positioned such that the pins 18 formed on the base 11 abut on the top ends of the sloped guide slots 28. When the chair back 4 is reclined, the resulting movement of the back bracket described above causes the chair seat 3 to be displaced relative to the base 11. The slots 28 provided in the slide rail members 14 are displaced relative to the pins 18 formed on the base 11 in the forward and upward direction. In the position illustrated in FIG. 8, in which the chair back 4 is in its rearmost position and the guide member 16 abuts on an end of the guide track 25, the pins 18 formed on the base may abut on the bottom ends of the sloped guide slots 28.

While, with reference to FIGS. 3-8, an embodiment has been described in which the coupling arrangement for coupling the back bracket to the base has a guide track formed on the back bracket and a guide member provided on the base, other configurations may be implemented in further embodiments. In particular, in further embodiments, the coupling arrangement for coupling the back bracket to the base may have a guide track provided on the base and a guide member provided on the back bracket, as will be explained with reference to FIGS. 9-11.

Figure 9:
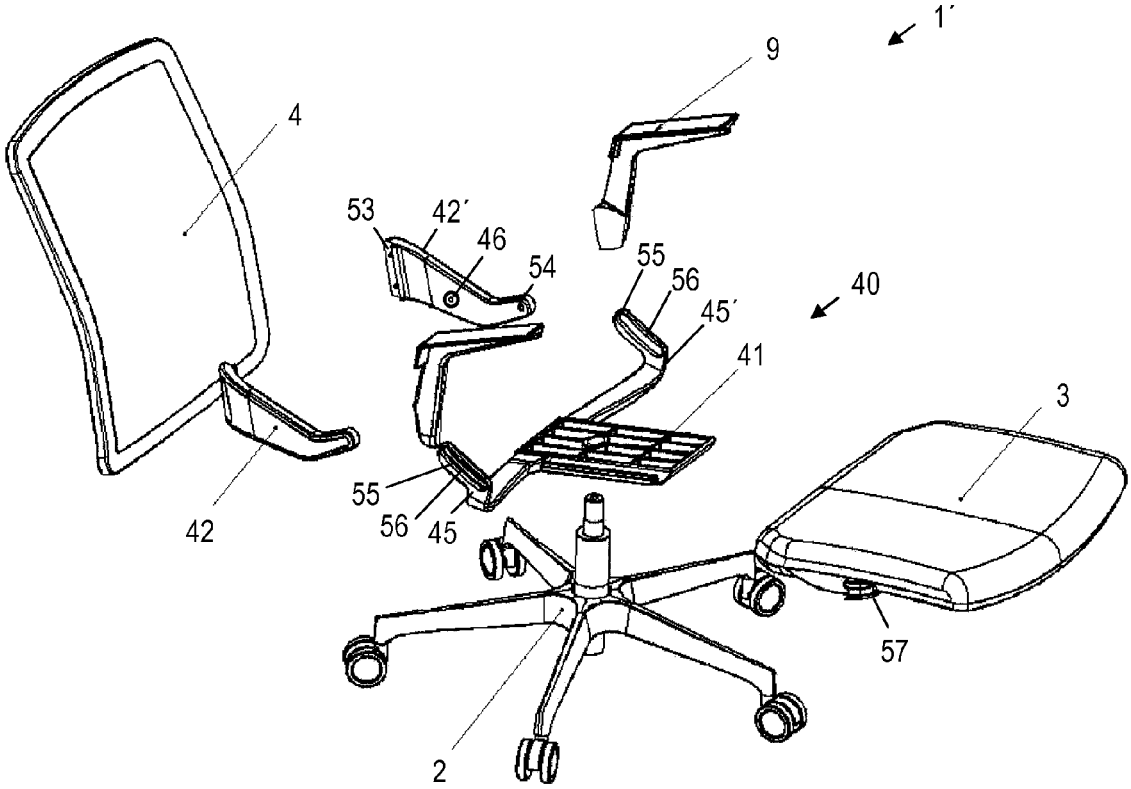
FIG. 9 is an exploded perspective view of a chair having a tilt mechanism according to another embodiment.

FIG. 9 is an exploded perspective view of a chair 1' which comprises a tilt mechanism 40 according to another embodiment. Elements and arrangement which correspond, with regard to their construction or function, to elements and arrangements of the chair and tilt mechanism described with reference to FIGS. 3-8 are designated by the same reference numerals.

The chair 1' includes a chair base assembly 2, a chair seat 3, a chair back 4 and the tilt mechanism 40. A pair of arm rests 9 may be provided.

The tilt mechanism 40 is operative to implement a coordinated movement of the seat 3 and of the back 4 when the back 4 is tilted. The tilt mechanism 40 generally includes a base 41, a pair of back brackets 42 and 42', a coupling arrangement which couples the back bracket 42 to the base 41 and a further coupling arrangement which couples the further back bracket 42' to the base 41. While only the structures on the inner side of the back bracket 42' can be seen in FIG. 9, the back bracket 42 has a corresponding configuration. In the illustrated implementation, the back brackets 42 and 42' may be mirror-symmetric relative to the centre longitudinal plane of the tilt mechanism 40.

The base 41 has a bottom plate on which the chair seat 3 is displaceably supported. A suitable guide arrangement may be provided to define the movement of the chair seat 3 relative to the base 41. The base 41 has two side wings 45 and 45'. The two side wings 45 and 45' are spaced, so that the seat chair 3 may be received therebetween. A guide track 55 defining a channel 56 is respectively formed on each one of the side wings 45 and 45'. The two guide tracks 55 provided on the side wings 45 and 45' of the base may be arranged such that the chair seat 3 is interposed between the guide tracks, for at least one of the positions of the chair back 4. In an embodiment, the chair seat 3 may remain interposed between the two guide tracks 55 provided on the side wings 45 and 45' for all positions of the chair back 4 and chair seat 3 relative to the base 11 which can be attained using the tilt mechanism 40.

The back brackets 42 and 42', respectively have a back attaching portion 53 disposed at an end thereof. The back attaching portion may be formed as a recess 53 having a longitudinal axis for receiving a corresponding side member of the chair back 4. The back attaching portions 53 of the back brackets 42 and 42' define a mounting plane in which at least a portion of the chair back 4 is arranged. The back brackets 42 and 42' further include, on their end opposite to the end on which the back attaching portion 53 is provided, a pivot coupling portion 54. The pivot coupling portion 54 is formed to allow the back bracket 42 or 42 to be articulated to the chair seat 3.

A mating pivot coupling portion 57 is provided on the chair seat 57. In the illustrated embodiment, the chair seat 3 may include a plastic body which supports a seat cushion. The mating pivot coupling portion 57 may be formed integrally with the plastic body or may be provided on a separate member which may be affixed to the chair seat 3.

In the installed state, the back bracket 42 is coupled to the base 41 via a coupling arrangement which includes the guide track 55 formed on the side wing 45 of the base 41 and a guide member. The guide member is provided on the back bracket 42 and, in the installed state of the tilt mechanism, is displaceably supported in the channel 56 defined by the guide track 55. Similarly, the back bracket 42' is coupled to the base 41 via a further coupling arrangement which includes the guide track 55 formed on the side wing 45' of the base 41 and a guide member 46. The guide member 46 is provided on the back bracket 42' and, in the installed state of the tilt mechanism, is displaceably supported in the channel 56 defined by the guide track 55. The guide member 46 is provided on a portion of the back bracket 42 or 42' extending from the back attaching portion 53 to the pivot coupling portion 54. I.e., the guide member 46 is arranged on the back bracket 42 or 42' at a position intermediate between the back attaching portion 53 and the pivot coupling portion 54. The guide member 46 may be formed as a pin, roller or other member which can be displaceably received in the channel 56.

The back attaching portion 53 of the back bracket 42 and the back attaching portion 53 of the back bracket 42' provided on opposing longitudinal sides define a mounting plane in which at least a portion of the chair back extends. In the installed state of the tilt mechanism, the guide members 46 and the guide tracks 56 receiving the same are provided on the same side, relative to the mounting plane, as the base 41. The guide members 46 and the guide tracks 56 engaged therewith are located in the forward direction of the chair relative to the mounting plane defined by the attaching portions 53 of the back brackets 42 and 42'.

The channel 56 defined by the guide track 55 may have a curved shape. The channel 56 defined by the guide track 55 may in particular have a radial shape. It will be appreciated that the channel 56 defined by the guide track 55 has a centre of curvature which is offset from the position of the pivot coupling portion 54, when the tilt mechanism 40 is in its installed state. The centre of curvature of the channel 26 is arranged at a distance from the chair base plane which is greater than the maximum distance of the top face of the chair seat 3 from the chair base plane, when the chair seat 3 is mounted to the tilt mechanism 40.

In use of the tilt mechanism 40, the back bracket 42 and the further back bracket 42' are fixedly attached to the chair back 4. When the chair back 4 pivots, the back bracket 42 and the further back bracket 42' fixedly attached thereto also pivot about their pivot coupling portion 54. The guide member 46 provided on the back bracket 42 is displaced along the channel 56 of the guide track 55 in which it is received. When the chair back 4 pivots in a rearward direction, the pivot coupling portion 54 of the back bracket 42 and the pivot coupling portion 54 of the back bracket 42' are respectively displaced in the forward and upward direction, forcing the chair seat 3 to be also displaced in the forward and upward direction. This movement is effected by the interplay of the articulated movement of the back bracket 42, 42' about the pivot coupling portion 54 and by the relative displacement of the guide member 46 and the curved channel 56 defined by the guide track 55, which has a centre of curvature offset from the pivot coupling portion 54. When the chair back 4 pivots in a forward direction, the pivot coupling portion 54 of the back bracket 42 is displaced in the rearward and downward direction, forcing the chair seat 3 to be also displaced in the rearward and downward direction.

The configuration and operation of a tilt mechanism in which a guide track is formed on the base and a guide member displaceably supported therein is provided on the back bracket will be described further with reference to FIGS. 10 and 11.

Figure 10:
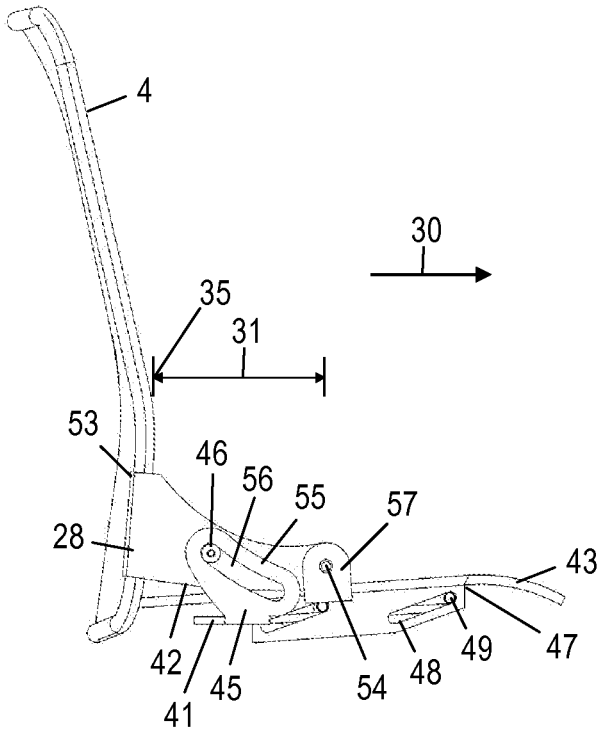
FIG. 10 is a cross-sectional view of a chair superstructure having a tilt mechanism according to yet another embodiment with the chair back in its foremost position.
Figure 11:
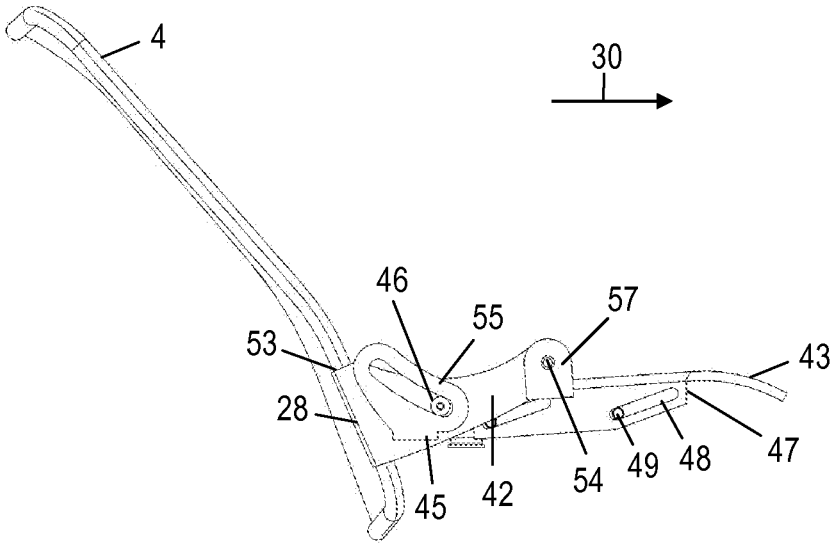
FIG. 11 is a cross-sectional view of the chair superstructure of FIG. 10 with the chair back in its rearmost position.

FIG. 10 is a cross-sectional view of the chair superstructure with the chair back in its foremost position, and FIG. 11 is a cross-sectional view of the chair superstructure with the chair back in its rearmost position. The tilt mechanism has a configuration generally corresponding to the one illustrated in FIG. 9. For clarity, a seat board 43 (for example, a plywood seat board) is illustrated in FIGS. 10 and 11 on which, in use, a seat cushion may be arranged. The cross-sectional views are respectively taken on a plane intersecting the guide track 55 and the guide member 46 disposed therein.

The tilt mechanism has a base 41, a back bracket 42 and a coupling arrangement coupling the back bracket 42 to the base 41. The coupling arrangement includes a guide track 55 formed in a side wing 45 of the base 41 and a guide member 46 displaceably supported in the guide track 55. The seat board 43 is displaceably supported on the base 11. For illustration, one or several slide rail member(s) 47 may be affixed to the seat board 43 on a lower side of the seat board 43. One or plural sloped slot(s) 48 may be provided in the slide rail member(s) 47. A pin 49 provided on the base 41 may be received in a slot 48 to guide movement of the seat 3 relative to the base 41.

The back bracket 42 is articulated to the seat board 43. A pivot coupling portion 54 is provided on the front end of the back bracket 42. A mating pivot coupling portion 57 is provided on the seat board 43. The mating pivot coupling portion 57 may be integrally formed with the seat board 43 or may be a separate member fixedly attached to the seat board 43. The back bracket 42 is fixedly attached to the chair back 4 at the back attaching portion 53. The back attaching portions 53 of two back brackets provided on opposite lateral sides of the chair define a mounting plane in which a portion 28 of the back 4 is arranged. The coupling arrangement is provided on the same side relative to the mounting plane as the base 11, for all positions of the chair back 4. When the chair back 4 is in its foremost position, the pivot coupling portion 54 may be disposed at a distance 31 in the range from 150 mm to 250 mm forward of a lumbar support portion 35 of the chair back 4.

When the chair back 4 pivots, the guide member 46 provided on the back bracket 42 moves along the stationary guide track 55. The resulting displacement of the pivot coupling portion 54 displaces the mating pivot coupling portion 57 and the seat board 43 relative to the base 41. The pins 49 on the base 41 may move along the guide slots 48, to guide displacement of the seat board 43 relative to the base 41. In particular, when the chair back 4 pivots rearwardly, the back bracket 42 also pivots about the pivot coupling portion 54. The guide member 46 moves along the channel 56 of the guide track 55, causing the pivot coupling portion 54 to be displaced in a forward and upward direction. This causes the mating pivot coupling portion 57 and the seat board 43 to be displaced, relative to the base 11, in the forward and upward direction. Similarly, when the chair back 4 pivots forwardly, the back bracket 42 also pivots about the pivot coupling portion 54. The guide member 46 moves along the channel 56 of the guide track 55, causing the pivot coupling portion 54 to be displaced in a rearward and downward direction. This causes the mating pivot coupling portion 57 and the seat board 43 to be displaced, relative to the base 11, in the rearward and downward direction.

While tilt mechanisms according to embodiments have been described in detail with reference to the drawings, modifications thereof may be implemented in further embodiments. For illustration, additional mechanisms may be integrated into the tilt mechanism to implement additional functionalities. Such mechanisms may include a mechanism for adjusting a restoring force of the chair back or similar.

For further illustration, while tilt mechanisms have been described in which a guide track is formed as a blind slot or through slot, other configurations of guide tracks may be used in further embodiments. For illustration, a guide track provided on one of the base and the back bracket may define plural channels, in which plural guide members provided on the other one of the base and the back bracket may be received.

For further illustration, while tilt mechanisms have been described in which the pivot coupling portion is engaged with a mating pivot coupling portion attached to the chair seat, the mating pivot coupling portion may be integrally formed with the chair seat.

For further illustration, while tilt mechanisms have been described in which the tilt mechanism includes a guide arrangement including slide rails engaged with pins to guide movement of the chair seat relative to the base, other configurations of guide arrangements may be utilized in other embodiments. For illustration, one link or plural links articulated to the base and to the chair seat may be utilized to guide movement of the seat chair relative to the base.

While exemplary embodiments have been described in the context of office-type chairs, the tilt mechanisms and chairs according to embodiments of the invention are not limited to this particular application. Rather, embodiments of the invention may be employed to effect a coordinated movement of a chair back and chair seat in a wide variety of chairs.

The invention claimed is:

1. A tilt mechanism for a chair, configured to effect a coordinated movement of a chair seat and chair back, said tilt mechanism comprising:

a base configured to be coupled to a chair base assembly, a back bracket comprising a back attaching portion configured to be attached to said chair back and a pivot coupling portion configured to pivotably couple said back bracket to said chair seat, the pivot coupling portion defining a pivot axis that remains stationary relative to the chair seat during a pivoting movement of the back bracket, a coupling arrangement configured to couple said back bracket to said base, said coupling arrangement comprising a guide track formed to have at least one channel and at least one guide member configured to be displaceably supported in said at least one channel, said at least one channel being curved, one of said guide track and said at least one guide member being provided on a portion of said back bracket extending from said back attaching portion to said pivot coupling portion, and the other one of said guide track and said at least one guide member being provided on said base, said tilt mechanism being configured such that, when said coupling arrangement couples said back bracket to said base, pivoting said back bracket about said pivot coupling portion causes said guide member and said guide track to be displaced relative to each other, effecting a displacement of said pivot coupling portion relative to said base.

2. The tilt mechanism of claim 1, said back attaching portion of said back bracket defining a mounting plane for said chair back, said tilt mechanism being configured such that said base and said guide track are provided on the same side relative to said mounting plane when said coupling arrangement couples said back bracket to said base.

3. The tilt mechanism of claim 1, said at least one channel being radially curved.

4. The tilt mechanism of claim 1, said at least one channel having a centre of curvature which, when said coupling arrangement couples said back bracket to said base, is spaced from said pivot coupling portion.

5. The tilt mechanism of claim 1, said back attaching portion being formed on an end of said back bracket.

6. The tilt mechanism of claim 1, further comprising:

a second back bracket comprising a second back attaching portion configured to be attached to said chair back and a second pivot coupling portion configured to pivotably couple said second back bracket to said chair seat, and a second coupling arrangement configured to couple said second back bracket to said base.

7. The tilt mechanism of claim 6, configured such that, when said coupling arrangement couples said back bracket to said base and said second coupling arrangement couples said second back bracket to said base, said back bracket and said second back bracket are spaced from each other so as to allow said chair seat to be positioned therebetween.

8. The tilt mechanism of claim 6, configured to support said chair seat such that, for at least one position of said back bracket relative to said base, a portion of said chair seat is interposed between said coupling arrangement and said second coupling arrangement.

9. A chair, comprising:

a chair base assembly, a chair seat, a chair back, and a tilt mechanism according to claim 1, said base being coupled to said chair base assembly, said chair seat being displaceably coupled to said base, said back bracket being attached to said chair back at said back attaching portion and being articulated to said chair seat at said pivot coupling portion, said chair being configured such that pivoting said chair back causes said guide member and said guide track to be displaced relative to each other, effecting a displacement of said pivot coupling portion and said chair seat relative to said chair base assembly.

10. The chair of claim 9, said chair having a forward direction, said coupling arrangement being arranged in said forward direction relative to said chair back.

11. The chair of claim 10, said pivot coupling portion being arranged in said forward direction relative to said coupling arrangement.

12. The chair of claim 10, said chair back comprising a lumbar support, and said pivot coupling portion being arranged from 150 mm to 250 mm forward from said lumbar support when said chair back is in its foremost position.

13. The chair of claim 9, said at least one channel overlapping with said chair seat, when viewed in a lateral direction of said chair, for at least one position of said chair back relative to said chair base assembly.

14. The chair of claim 13, said at least one channel overlapping with said chair seat, when viewed in said lateral direction of said chair, for all positions of said chair back relative to said chair base assembly.

15. The chair of claim 9, said chair base assembly defining a chair base plane, at least a portion of said at least one channel being disposed at a height above said chair base plane smaller than a maximum height of a top surface of said chair seat above said chair base plane and greater than a minimum height of a bottom surface of said base above said chair base plane.

16. A tilt mechanism for a chair, configured to effect a coordinated movement of a chair seat and chair back, said tilt mechanism comprising:

a base configured to be coupled to a chair base assembly, a back bracket comprising a back attaching portion configured to be attached to said chair back and a pivot coupling portion configured to pivotably couple said back bracket to said chair seat, the pivot coupling portion defining a pivot axis that remains stationary relative to the chair seat during a pivoting movement of the back bracket, a coupling arrangement configured to couple said back bracket to said base, said coupling arrangement comprising a guide track formed to have at least one channel and at least one guide member configured to be displaceably supported in said at least one channel, one of said guide track and said at least one guide member being provided on said back bracket at an intermediate location between said back attaching portion and said pivot coupling portion, and the other one of said guide track and said at least one guide member being provided on said base, said tilt mechanism being configured such that, when said coupling arrangement couples said back bracket to said base, pivoting said back bracket about said pivot coupling portion causes said guide member and said guide track to be displaced relative to each other, effecting a displacement of said pivot coupling portion relative to said base.

17. The tilt mechanism of claim 16, said at least one channel being curved.

18. The tilt mechanism of claim 16, said at least one channel being radially curved.

19. A chair, comprising:

a chair base assembly, a chair seat, a chair back, and a tilt mechanism according to claim 16, said base being coupled to said chair base assembly, said chair seat being displaceably coupled to said base, said back bracket being attached to said chair back at said back attaching portion and being articulated to said chair seat at said pivot coupling portion.

* * * * *